US010709251B1

(12) United States Patent
Rothman et al.

(10) Patent No.: US 10,709,251 B1
(45) Date of Patent: Jul. 14, 2020

(54) PORTABLE SEAT CUSHION WITH SELF-CONTAINED HEAT SOURCE

(71) Applicants: Janet Lynn Rothman, New York, NY (US); Richard Lee Strauss, Freeport, NY (US)

(72) Inventors: Janet Lynn Rothman, New York, NY (US); Richard Lee Strauss, Freeport, NY (US)

( * ) Notice: Subject to any disclaimer, the term of this patent is extended or adjusted under 35 U.S.C. 154(b) by 0 days.

(21) Appl. No.: 16/501,263

(22) Filed: Mar. 13, 2019

(51) Int. Cl.
*A47C 7/74* (2006.01)
*A47C 7/16* (2006.01)
*A47C 7/18* (2006.01)
*A47C 7/02* (2006.01)

(52) U.S. Cl.
CPC ..... *A47C 7/748* (2013.01); *A47C 7/021* (2013.01); *A47C 7/16* (2013.01); *A47C 7/18* (2013.01)

(58) Field of Classification Search
CPC .. B32B 5/18; B32B 5/32; A47C 7/748; A47C 21/04; A61G 5/1045
See application file for complete search history.

(56) References Cited

U.S. PATENT DOCUMENTS 3,802,220 A * 4/1974 Pompo ..... F25D 3/00 62/530
3,922,879 A * 12/1975 Arnold ..... F25D 3/00 62/458
4,060,276 A * 11/1977 Lindsay ..... A47C 7/74 297/180.11
5,979,975 A * 11/1999 Hiraoka ..... A47C 7/748 297/180.11
6,061,856 A * 5/2000 Hoffmann ..... A47C 27/148 5/706
6,109,256 A * 8/2000 Sardi ..... A47C 7/748 126/204
8,567,347 B2 * 10/2013 Leahy ..... A01K 1/0353 119/28.5
2005/0045623 A1 * 3/2005 Schenck ..... A47C 21/048 219/528
2006/0158011 A1 * 7/2006 Marlovits ..... A47C 7/02 297/180.1
2006/0244289 A1 * 11/2006 Bedro ..... B60N 2/5621 297/180.1
2007/0096519 A1 * 5/2007 Conforti ..... A47C 31/126 297/218.2
2008/0030062 A1 * 2/2008 Prust ..... A47C 7/74 297/452.45
2009/0010468 A1 * 1/2009 Oser ..... H04R 5/023 381/332
2015/0033474 A1 * 2/2015 Mikkelsen ..... A47G 9/1036 5/421
(Continued)

*Primary Examiner* — Shin H Kim
(74) *Attorney, Agent, or Firm* — Richard L. Strauss, Esq.

(57) ABSTRACT

A portable seat cushion providing enhanced seating comfort while also enabling the use of self-contained heat sources is disclosed which provides greater comfort to users during cold weather outdoor entertainment events. The cushion includes especially configured recessed pockets and carriers for containing and strategically placing heat generators such as lighter fluid fueled and electric hand warmers in close contact with a user's legs while sitting. Sufficient ventilation is provided to enable combustion type hand warmers to access sufficient oxygen and vent exhaust.

16 Claims, 5 Drawing Sheets

(56) References Cited

U.S. PATENT DOCUMENTS

| | | | | |
|---|---|---|---|---|
| 2015/0164229 | A1* | 6/2015 | Popp | A47C 27/081 5/652.1 |
| 2015/0208815 | A1* | 7/2015 | Chandler | A47C 21/044 5/421 |
| 2015/0257540 | A1* | 9/2015 | Chandler | H01L 35/325 5/421 |
| 2016/0089059 | A1* | 3/2016 | Hu | A61B 5/0476 600/301 |
| 2016/0152167 | A1* | 6/2016 | Kozlowski | B60N 2/5621 297/180.12 |

* cited by examiner

PORTABLE SEAT CUSHION WITH SELF-CONTAINED HEAT SOURCE

TECHNICAL FIELD

The present invention is most closely related to the field of portable seat cushions intended for use upon outdoor stadium, bus, train and other public seating. More specifically, the present invention discloses a seat cushion providing enhanced seating comfort while also enabling the use of self-contained heat sources which provide greater comfort to users during cold weather outdoor entertainment events.

BACKGROUND OF THE ART

In the past, it has been known to produce portable seat cushions formed of a resilient material such as, for example, an elastic foam material especially configured, designed and adapted for placement upon seats found in both public and private outdoor entertainment venues. These venues, such as, for example, football stadiums, baseball stadiums, outdoor concert areas are often equipped with practical, but rather rigid seating. The rigid nature of such seats, often constructed of a hard plastic, wood or metal are not particularly comfortable to sit upon, especially during prolonged concerts, sporting events and other publically viewed activities. In order to relieve the pressure of sitting upon such hard surfaces, portable seat cushions have been manufactured, sold and utilized as a soft resilient layer intended to cover the seating surfaces upon which an individual is seated—especially the areas of the seat upon which the upper legs, buttocks and lower back are supported—.

It has been known to produce such outdoor seating cushions with sufficient resilient foam material to reduce painful pressure points at the above-mentioned anatomical sitting areas. These cushions are often enclosed in a water-proof plastic cover in order to provide a water-proof barrier. Many of the prior art cushions are light enough to be easily transported to a site of use and, due to the compression-friendly nature of the foam selected for their manufacture, are easily folded so as to simplify packing them within a bag or other carrier. Some seat cushions may also include a strap or other simple handle to further enhance portability.

Besides the rather uncomfortable rigid seating commonly found in public venues and transportation, temperatures, especially at outdoor arenas, amphitheaters and stadiums may often drop to uncomfortable levels. Although cold temperatures may not be a problem for short duration events with appropriately clothed individuals, events taking longer periods of time such as outdoor concerts and sporting events may often last many hours during which such cold temperatures may adversely effect spectators forced to sit in already uncomfortable rigid seats. It would be highly desirable if a seat cushion could be disclosed especially designed, shaped and configured to accept, contain and safely operate a heat source. It would be still further advantageous if such a portable cushion could be utilized with and without such a heat source, but retaining the ability to incorporate the heat source by simply adding a removable heat source from the especially configured cushion.

SUMMARY OF THE INVENTION

Now, in accordance with the present invention, a portable seat cushion is disclosed which provides a comfortable and resilient seating surface while, at the same time, being especially designed, shaped and configured to incorporate a heat generating source. The portable seat cushion of the present invention is comprised of a cushion body fabricated from a resilient material such as, for example, a plastic foam material, at least one heat generator pocket formed within the cushion body, at least one heat generator carrier (also referred to herein as "heat generator caddy", at least one ventilation conduit and a seat cushion cover.

The cushion body of the present invention has an top surface, a bottom surface as well as a front side, rear side, left side and right side surface. The cushion body demonstrates a thickness dimension running from the top to bottom surface, a width dimension running from a midpoint of the right and left side surfaces, and a depth dimension running from a midpoint of the front side and rear side surfaces. The cushion body is designed, shaped and configured to generally conform with the shape of a public seating surface upon which the upper legs, buttocks and lower back of a user are supported. For increased comfort, in certain preferred embodiments of the present invention, that area of the cushion body adjacent to the rear surface thereof, which, during use, generally underlies the "tail bone" (coccyx)l of a person seated thereupon is tail bone cut away—which is referred herein as a "coccyx indentation." The coccyx cut-away may be formed in a "V", "U" shaped or any other indentation pattern that is located upon the back portion of the cushion body, as described in more detail, below, in order to remove pressure from that anatomical structure during cushion use. The location of coccyx indentation or, as it may also be referred—the "tail bone cut away"—is best described as follows. The rear surface of the cushion body can be described as having a right end—adjacent to the right surface of the cushion body—and a left end—adjacent to the left surface of the cushion body. The distance between the right and left end of the rear surface is described herein as the length of the rear surface of the cushion body. A midpoint of the rear surface of the cushion body is located at a point halfway between the right an left ends of the rear surface of the cushion body—or, as it may also be referred to, as the midpoint of the rear surface of the cushion body. formed at the rear surface of the cushion body at a point midway The seat cushion also is shaped and configured to include at least one heat generator pocket especially designed, shaped and configured to closely contain a heat generator carrier. (In certain preferred embodiments of the present invention, the portable seat cushion includes a foam insert demonstrating a shape, size and dimension enabling the foam insert to fill the at least one heat generator pocket, when not in use as a site for housing the heat generator carrier and heat generator therewithin. The at least one heat generator pocket includes a bottom surface, right side surface, left side surface, rear side surface and front side surface. At least one ventilation conduit aperture (also referred to herein as a "ventilation aperture" is formed within the cushion body so as to provide fluid communication between at least one of the pocket side surfaces and a corresponding side surface of the cushion body so as to provide a space for placement of the at least one ventilation conduit. As discussed in more detail, below, a ventilation conduit, a tube like structure shaped and configured for retentive placement within the ventilation conduit aperture, provides a passageway between the pocket and air outside the cushion. It is preferable that at least two such ventilation conduit apertures are provided. Each such aperture is especially shaped and configured to demonstrate a length and diameter enabling mating engagement of a corresponding ventilation conduit so that the length of the conduit and aperture are substantially equal.

It is preferred that the cushion body be formed of a pliable foam material such as for example, a polyethylene, polyurethane foam or latex foam. It is preferred, especially in light of use with the heat generator, that polyurethane foams be selected to incorporate a flame retardant such as, for example, tris (1,3-2 dichloroisopropyl) phosphate (TDCPP). However it is still more preferred to utilize a natural latex foam which generally do not require flame retardants to pass flame retardant standards such as Cal 117. Meeting such flame resistance standards is accomplished as an example of overcautious protection as the combustion type heater utilized in practicing the present invention does not produce a flame. However, such heaters are fueled by combustible fuel which are initially ignited with a flame outside of the cushion and so utilization of flame resistant materials is believed to be prudent. As to cushion seating comfort, it is preferred that the foam material have a thickness of from about 2 to 4 inches with an indentation load deflection of from about 30 to 35 (ILD).

The heat generator caddy of the present invention demonstrates a bottom section, rear side wall, front side wall, right side wall and left side wall. In addition, the caddy advantageously includes a top cover which is pivotally mounted upon, for example, the right and left side walls of the caddy, adjacent to the rear side walls. The top cover is configured and adapted to swing upwards so as to expose the interior of the caddy for placement and removal of the heat generator and to pivot down into a locking position to firmly hold the heat generator within the interior of the caddy. Each of the side walls of the caddy, as well as the top cover and bottom section advantageously include ventilation apertures to allow air for combustion and heat generated by the heat generator to flow in and out of the caddy during use. The ventilation apertures formed within the side walls of the caddy are advantageously formed so as to allow receipt and securing therein of ventilation conduits. The at least one air flow conduit is fitted within the ventilation apertures formed in the cushion body, and running from the side walls of the cushion body to the caddy pocket. The conduit thus forms a fluid pathway for air flowing to the heat generator for combustion and exhaust flowing out from the heat generator as a byproduct of such combustion. Such conduits are required when, for example, a liquid fuel burning catalytic heater is utilized as the heat generator housed within the heat generator caddy. The at least one ventilation conduit is generally tubular in shape with a hollow central bore and openings located at a medial and distal end thereof, the openings both being continuous with the central bore of the conduit. The conduit demonstrating a length running from the medial to distal end thereof. The conduit thus forming a pathway through which gaseous materials, such as atmospheric air (and the oxygen therein) from outside the cushion required for combustion can flow towards the heat generator and combustion gases generated by the heat generator can exit the cushion body as well as the cushion cover (via apertures 25 formed in the cover) to the atmosphere surrounding the portable cushion.

The heat generator caddy is preferably formed from a rigid or semi rigid heat resistant plastic such as, for example, Polyamideimides (PAIs), High-performance polyamides (HPPAs), Polyimides (Pis), Polyketones, Polysulfone derivatives-a, Polycyclohexane dimethyl-terephthalates (PCTs), Fluoropolymers, Polyetherimides (PEIs), Polybenzimidazoles (PBIs), Polybutylene terephthalates (PBTs), Polyphenylene sulfides, Syndiotactic polystyrene as well as other high performance plastic polymers. Other polymer plastics may also be utilized as long as they exhibit a highest working temperature of at least 140 to 150 degrees Fahrenheit. In addition, heat conductive additives such as graphite carbon fibers and ceramics such as aluminum nitride and boron nitrides may be utilized to increase the thermal conductivity of caddies formed of plastic polymer. In addition, the caddy may be fabricated from a metallic material such as steel, a steel alloy or aluminum.

The heat generators utilized and intended to be utilized with the present invention are "self-contained heat generators". As utilized throughout this disclosure and within the claims, the term "self-contained heat generator" refers to a device, powered by a liquid or solid fuel, electricity, or chemical reaction, which generates heat without need for an external power source such as, for example, a power cord or fuel line. A self-contained heat generator especially suitable for use with the present invention includes combustion type hand warmer devices that catalytically (slow burn) common lighter fluid (light petroleum distillate or synthetic isoparaffinic hydrocarbon, commonly referred to as naphtha). Such warmers generate heat from flameless, slow combustion of naphtha and typically generate a surface temperature (surface of the device) of about 130 to 140 degrees degrees Fahrenheit. The naphtha fueled heat generators suitable for use include, but are not limited to Zippo® brand hand warmers which are available in both 12 hour models 3.9"×0.5"×2.6" as well as 6 hour models which are 2.9"×2.0"×0.6". Although electric/rechargeable handwarmers such as, for example, The Outdoors Brand model EL-24134 or Human Creations EnergyFlux Enduro Rechargeable Hand Warmer 700 mAh may be utilized and contained within the heat generator caddy of the present invention, such hand warmers generally put out insufficient heat for an insufficient time period so as to substantially reduce the utility of the present invention. Although such electrically driven heaters might fulfill the instant inventions secondary function of providing a safe and convenient place for hand warmer containment for hand warming access, they are not generally sufficient to provide enough heat for generation through the caddy to the users buttocks and upper legs. The depth of the at least one heat generator pocket as well as the dimensions of the heat generator caddy are selected so that when a heat generator caddy is placed within the heat generator pocket a space having a depth of from about 10 to 15 mm between the top surface of the caddy top cover and the top surface of the cushion body exists. This space, or, as it may more accurately described as "a recess" provides an open area through which heat generated by the warmer within the caddy may flow, unimpeded, to the user seated on top of the portable cushion, without interference from an intervening foam insert and with the advantage of providing an area of open for further convection of heat and movement of air (as compared to utilizing carrier and pocket dimensions placing the top surface of the carrier directly against the cushion cover upon which the user sits). As discussed below, in instances where a user wishes to moderate the heat generated by the heat generator(s) an insulator insert may be placed so as to fill this space and so reduce amount of heat transfer.

It is advantageous to provide a cover for the cushion body in order to protect the foam from debris, fluids such as, for example, water, and also for a pleasing appearance. For this purpose such covers can be fabricated from, for example, canvas, cotton, bamboo and other natural fibers fibers as well as synthetic fabrics such as polyester, polyester blends and nylon. As it may be further advantageous to treat such fabrics with water resistant additives, and such additives may reduce to porosity of such fabric to the air required, and the exhaust emitted by, for example, catalytic heat generators fueled by naphtha, it is important that the air/exhaust conduits penetrate through the cushion body cover.

DETAILED DESCRIPTION

Figure 1:
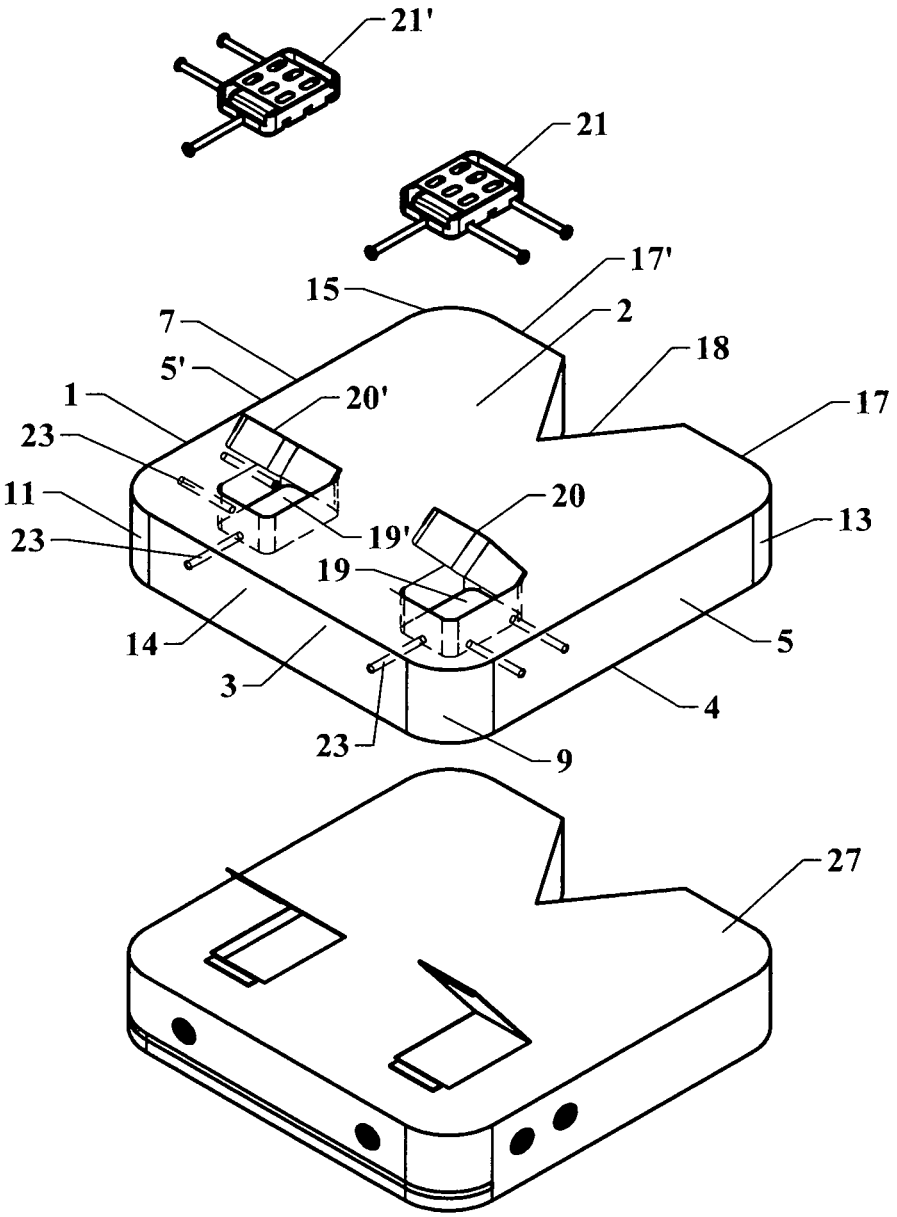
FIG. 1 is an exploded top isomeric view of a first preferred embodiment of the present invention showing internal detail
Figure 2:
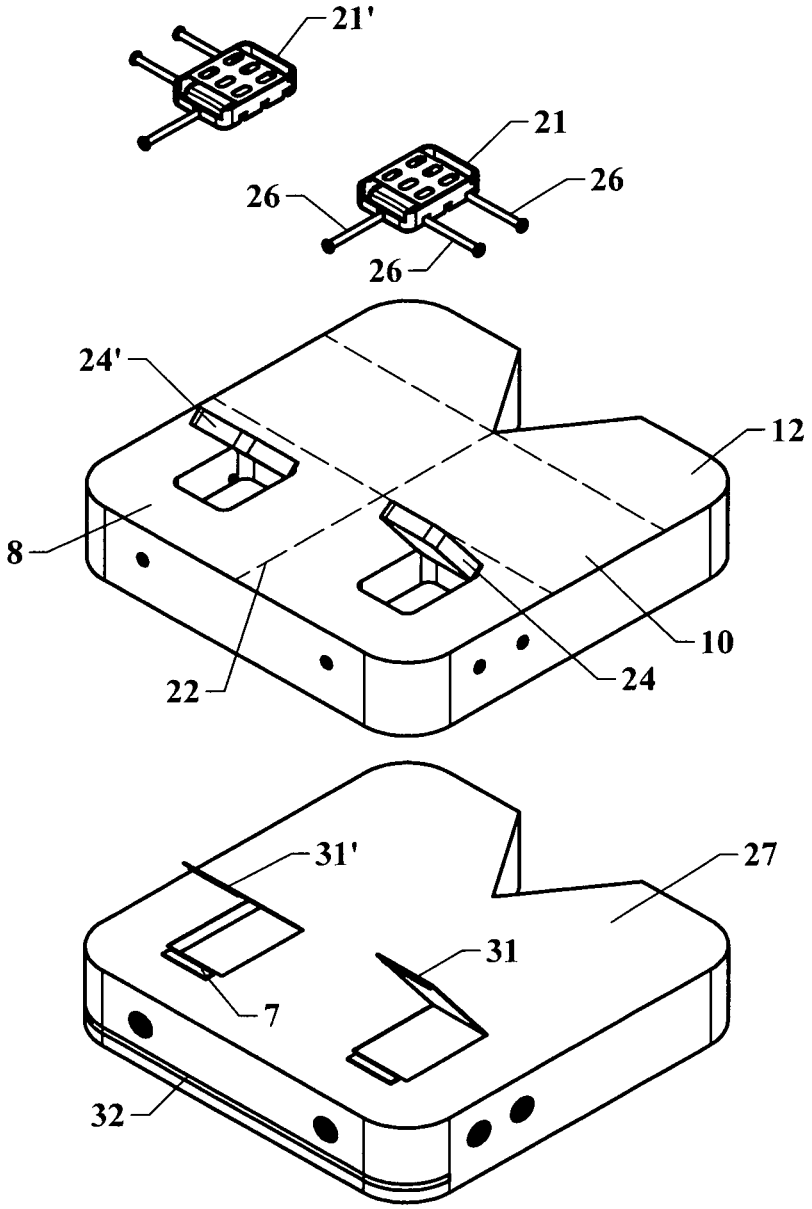
FIG. 2 is an exploded top isomeric view of a preferred embodiment of the present invention illustrated in FIG. 1.

FIG. 1 and FIG. 2 illustrate a first preferred embodiment of the present invention. The cushion body 1 is advantageously formed of a foam material as discussed above. Although the required elasticity, memory and resilience required in a comfortable seating material may be provided by either open and closed cell foam materials, it is preferred that the cushion body be formed from a closed cell type foam. This is primarily due to the fact that closed cell foams are less likely to retain as much moisture as open cell foams, but is also preferred as to closed cell foams greater resistance to migration of gases, such as exhaust gases, into their structure. are available in resilient, cushioning.

The cushion body includes a top surface 2, a bottom surface 4, front surface 3, two side surfaces 5/5', a rear surface 17/17' and, in the embodiment illustrated four corner surfaces 9, 11, 13 and 15. The preferred embodiment illustrated also includes a rear surface 17/17' which advantageously includes a coccyx indentation 18 which, in the embodiment shown within the figures, is "V" shaped. When, as described in more detail, below, the portable seat cushion is utilized, it is placed on an underlying seating surface so that the back surface of the cushion body—which ordinarily underlies and supports a user's buttocks—is adjacent to the back of the seating surface which, in turn, is adjacent to, for example, a back support incorporated into public seating. The front surface of the cushion body is oriented towards the front of the lower portion of a public seat which supports a portion of a user's upper legs. In this orientation, when a user sits upon the portable cushion, the users buttocks and upper legs will come into contact with the top surface 2 of the cushion body (and overlying top surface of the cushion cover) with the user's legs and knees extending beyond and forward of the front surface 3 and the upper portion of the user's buttocks and lower back adjacent to the rear surface 17/17' of the cushion body. The coccyx indentation 18, which is "V" shaped as illustrated, is intended and functions to relieve pressure which otherwise would result from the downward force of a user upon the coccyx region generated, in part, by the opposing resistance of a seat cushion body not having the subject indentation or, for that matter, upon sitting upon any relatively flat surface. In fact, the coccyx indentation can be shaped in any desirable configuration so long as the indentation is located in that portion of the back portion of the cushion body underlying a user's coccyx region during sitting. That portion of the cushion body closest to the front surface may be referred to as the front portion of the cushion body whereas that portion of the cushion body closest to the rear surface. The cushion body can also be described as have a forward ⅓ portion 8 (adjacent to the front surface of the cushion body), a rear ⅓ portion 12 (adjacent to the rear surface) and a middle ⅓ portion 10.

The at least one, and preferably, two heat generator pockets formed within the cushion body are positioned so as to be in the forward ⅓ of the top surface of the cushion body. More specifically, the heat generator pocket(s) are preferably located within the body of the seat cushion located within the front ⅓ portion 8 thereof wherein the entrance to the recess begins within the top surface of the cushion body proximal to the front surface 14 of the cushion body and substantially spaced, in regard to the right 5 and left 5' sides of the cushion body, evenly, between a midline reference line 22 of the cushion body. The term "midline reference line" as used throughout this specification and within the claims refers to an imaginary reference line running from the middle of the length of the front surface to the middles of the length of the back surface of the cushion—a reference line running from the front to the back of the cushion body and located midway between the right and left side surfaces of the cushion body. Such a position places the pockets and the heat generators located therein, under the legs of a user rather than alongside or between a users legs. This orientation also ensures heat generated will flow upwards towards the user's legs that generally have less insulating fat than the buttocks area.

As discussed above, the cushion body is shaped and configured to include at least one, and preferably two heat generator pockets 19/19' formed so as to accommodate the heat generator caddy, or, as it may also be referred to as, the heat generator carriers 21/21'. However, the portable seat cushion of the present invention contemplates utilization of the cushion during period of mild or warm weather as well when a heat generator might not be required. For that purpose, foam inserts 20/20' are provided as a means of occluding the heat generator pockets 19/19' when they are not otherwise in use (for providing space for the heat generators and heat generator carriers.) However, if desired to increase seating comfort and reduce heat flow, heater overlay foam inserts having a decreased depth 24/24' (as compared to the foam inserts intended to completely fill the heat generator pockets when the heat generator carriers are not being utilized) are advantageously provided and can be placed over a heat generator caddy so as to provide an even top surface.

As illustrated in FIG. 1, ventilation apertures 23 are formed within the cushion body in such a manner as to provide a pathway connecting the heat generator pocket and the front or side surfaces of the cushion body. They are formed so as to define a gas communication pathway between the heat generator pocket and atmosphere outside of the cushion body. The ventilation apertures 23 are designed, shaped and configured so as to allow matting insertion of the corresponding ventilation conduits therein which provide the actual gas pathway to and from the heat generators. It is preferred that the ventilation conduits be formed of a relatively rigid metal or plastic material so that, during compression of the cushion body during use, the those compressive forces will not cause partial or complete blockage of the airway required for operation of heat generators utilizing catalytic burners to release flameless heat from, for example, lighter fluid—as discussed in detail, above—. It is also preferred that these conduits demonstrate a diameter of from about to about 8 mm to about 20 mm. As shown in the figures, in one example of a preferred embodiment of the present invention, two generator pockets 19/19' are provided, each of which is ventilated by means of three ventilation apertures 23 each of which matingly receives a ventilation conduit 26.

The cushion body illustrated in FIG. 1. is covered, during use, by cover 27. As mentioned above, the cover serves to protect the cushion body from dirt, debris and moisture (if treated with, for example, a water proofing additive.) Although the cover can be made of a water proof plastic material, such is not preferred since plastics are, in general, difficult to recycle and can also block the radiation of heat from the heat generators when such are in use.

Figure 3:
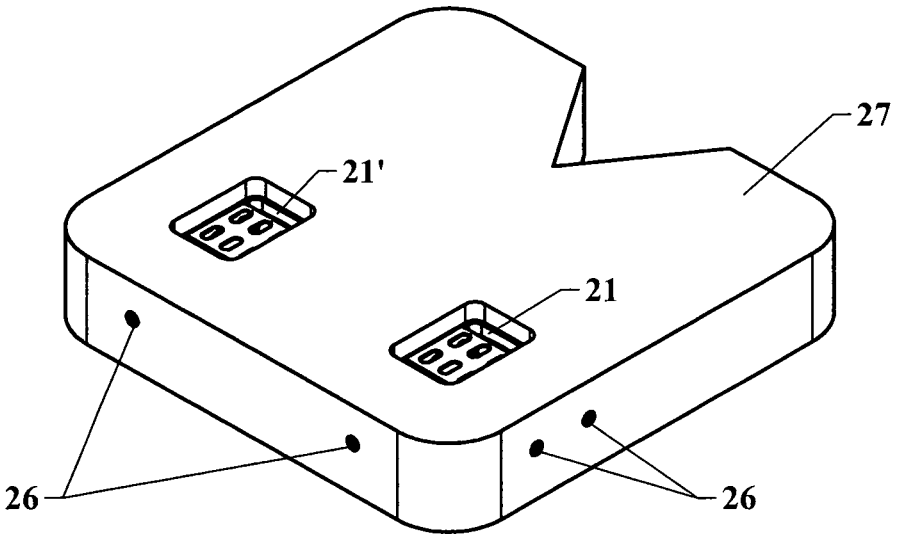
FIG. 3 is a top isomeric view of a preferred embodiment of the heat generator caddy illustrated in FIG. 2 containing a heat generator.

FIG. 3 illustrates the heat generator caddy shown in FIG. 1 with the heat generator caddies 21/21' inserted within the illustrated heat generator pockets 19/19'. As can be viewed within heat generator pocket 19' (in FIG. 2), a space is left between the top of heater caddy 21' and the top surface of the cushion body. This allows the heat radiating from the heat generator within the caddy a more direct and unobstructed pathway to the user. However, an overlay insert 24 may be placed directly over the heat generator carrier so as to eliminate the depression formed by the heat generator pocket and also so as to moderate heat radiating to the user. Because the ventilation conduits 26 provide a pathway for air to reach combustion type heat generators within the generator pockets and for exhaust gasses to flow away therefrom, covering the top of the heat generator caddies with the overlay inserts will not interfere with such heater operation.

As shown in FIGS. 1 and 2, the cushion cover 27 is advantageously provided, in the illustrated embodiment, with two access flaps 31/31' which provide openings to insert/remove the heat generator caddies, foam inserts and overlay inserts (and, of course, heat generators). Such flaps, formed in the fabric, may advantageously use hook and loop type fasteners (such as Velcro®), a zipper or other means of securing such flaps closed. Also, it is highly advantageous to utilize a zipper 32, hook and loop or other access closures to enable the cover 27, as illustrated in FIGS. 1 and 2, to be removable for cleaning and/or replacement. The cushion cover is configured to include ventilation openings 25 especially shaped and sized to allow passage of the at least one ventilation conduit therethrough and enabling the above and below described anchor ring portion of the at least one ventilation conduit to rest upon the outside of the cover.

Figure 4:
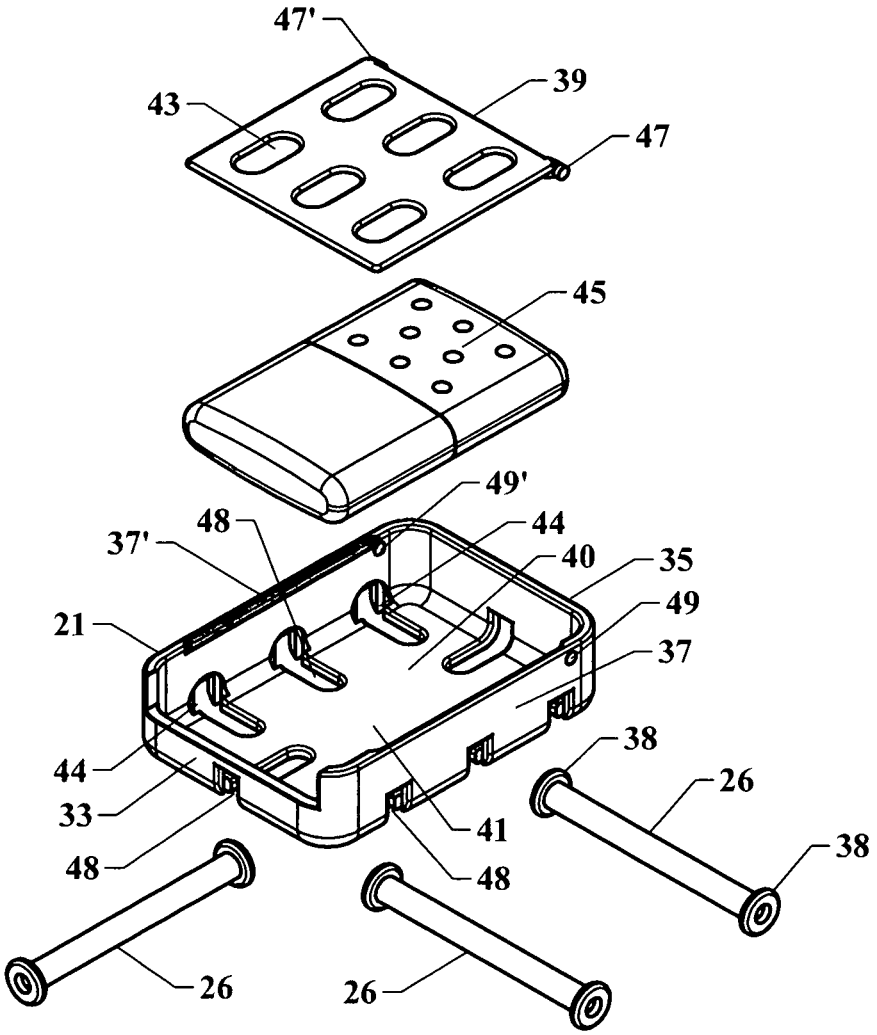
FIG. 4 is an top exploded bottom isomeric view of the heat generator caddy illustrated in FIG. 3.
Figure 5:
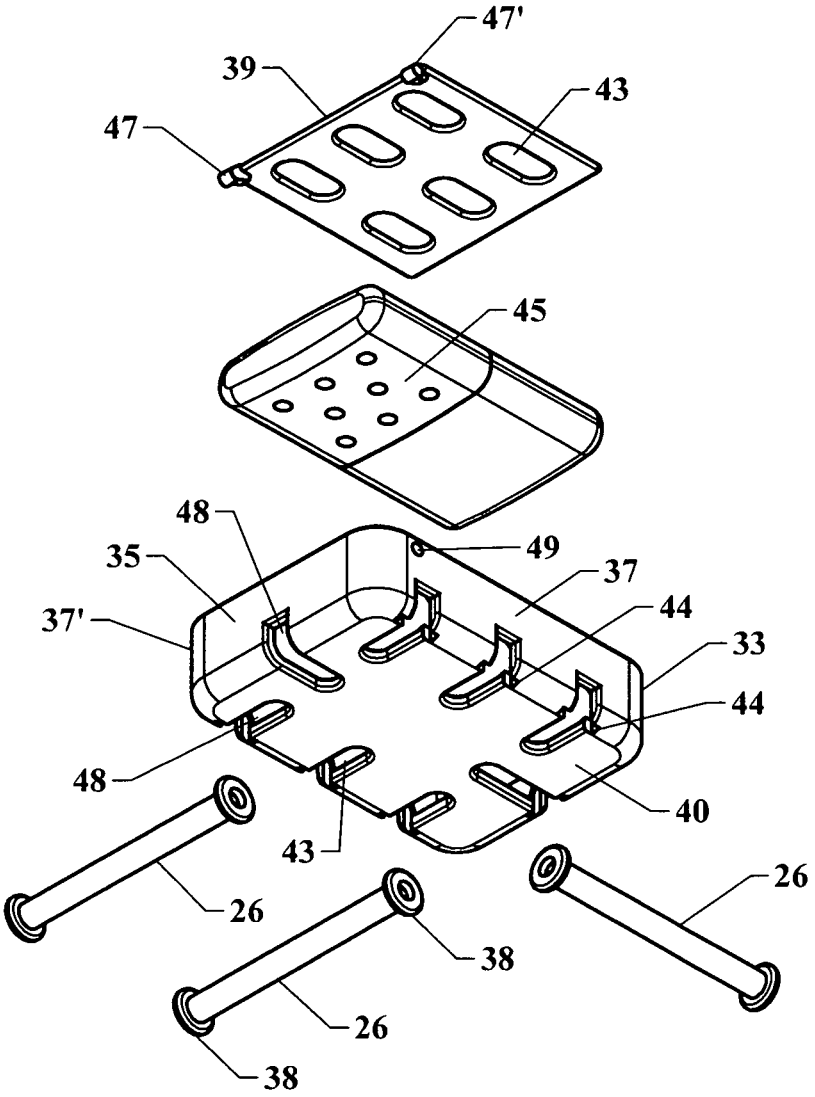
FIG. 5 is a bottom exploded isomeric view of the heat generator caddy, air flow conduits and heat generator illustrated in FIG. 3.

FIGS. 4 and 5 illustrate a heat generator carrier (which term is equivalent to the term "heat generator caddy" as utilized through this specification and in the claims) which is designed, adapted and especially configured to contain a heat generator such as, for example, a catalytic naphtha burning heater as described, in detail, above.

The heat generator caddy includes a front wall 33, a back wall 35, two side walls 37/37' and a bottom portion 40. The caddy also includes an open top portion 41 which allows insertion and removal of the heat generator 45. The caddy also includes a top cover 39 which includes ventilation apertures 43. The front, rear and side walls of the caddy include ventilation slots 48 which, especially as formed through the front and side walls, are especially shaped and configured to enable insertion of the anchor ring portion 38 of the ventilation conduits 26. More specifically, the aforementioned ventilation slots are shaped and configured to allow passage, at one expanded receiving area of each slot 48 of the anchor ring portion of a ventilation conduit. Each end of the ventilation conduits includes an anchor ring portion. Since the cushion body is formed of a flexible foam, the anchor ring portion at one end of the ventilation conduit can be inserted, from the front or side surface of the cushion body, through the ventilation conduit aperture formed in the foam until it reaches the heat generator pocket. Each conduit is formed as a hollow tube with opening on either end demonstrating with a length and dimension so that when is placed into a ventilation aperture located at the front or side portion of the caddy and urged into an anchored position, the anchor ring at the opposite end of the conduit lies flush against a side or front surface of the cushion cover overlying the front 3 and side 5 surfaces of the cushion body, respectively. In one mode of assembling the device, once a ventilation conduit is urged, from outside of the cushion body and overlying cushion cover (which includes ventilation openings 25 which align with the ventilation apertures formed within the cushion body 23) the conduit is further urged through the corresponding ventilation conduit 23. A ring portion located at that end of the conduit urged through the cushion body and cushion cover apertures until it enters the heat generator recess 19 formed within the cushion body. Once all such conduits are so urged into position within the heat generator pocket, the heat generator caddy 21 is positioned within the recess 19 in such a manner that the ring portion at one end of each such conduit enters into and expanded portion 44 of ventilation slots 48 so as to anchor the conduits in this position. The conduits define a length so that once the are urged through the apertures to the point where the ring portion at the other end of the ring lies flush with the outside of the cushion, the ring portion located at the opposite end of each conduit lies is a position, within the heat generator recess, in alignment with the expanded portion 44 of the ventilation slots located on the bottom surface 40 of the heat generator caddy. Thus, guiding the conduit into a respective slot in this manner, in combination with the "stop" effect of the anchor portion of the conduit adjacent to the side or front surface of the cushion anchors the conduit and caddy into position. For this purpose, it is advantageous to place all ventilation conduits into position first, and thereafter, lower the caddy upon the anchor portions as described above.

As mentioned above, the heat generator caddy (or carrier, as it is also referred to as), is configured and dimensioned to closely retain the heat generator. A top cover 39 is provided which can be fabricated from a rigid plastic capable of withstanding temperatures of up to 150 degrees without distortion or weakening. The cover, in the embodiment illustrated herein, advantageously includes a pivot extrusion 47/47' which rotatably mates with pivot hole 49/49'. However, the cover may be completely removable or utilize any other form of hinge with equal utility. It is also advantageous to include a locking mechanism to assure that the cover will remain closed until intentionally opened to place or remove a caddy and/or heat generator.

The portable cushion of the present invention provides added comfort to a user in any season as well as relief from pressure exerted upon the coccyx. This is especially advantageous during prolonged sitting such as, for example during a sporting event. However, use of the cushion with a heat generator such as a petroleum or alcohol based catalytic heater, electric heater or chemical heater, further extends the cushions benefits and utility in colder weather. Although, as discussed above, the portable cushion of the present invention is capable of utilizing the various forms of portable heaters and heat sources mentioned above, it is especially advantageous to utilize the cushion with a lighter fluid type heater such as the Zippo Brand® hand warmers, discussed above. Such warmers typically generate a surface temperature of from about 130 to about 140 degrees Fahrenheit for from about 6 to about 12 hours—without the generation of a potentially dangerous flame—. By creating a heat generator pocket and heat generator caddie of such dimensions as to leave from about 10 to 15 mm clearance from the top surface of the carrier cover to the top surface of the cushion body, a user can comfortable sit upon and be warmed by said cushion.

We claim:

1. A portable seat cushion especially designed, configured and adapted to incorporate at least one self-contained heat generator wherein said cushion comprises a cushion body, at least one heat generator carrier, at least one ventilation conduit and a cushion cover wherein:

the cushion body includes a top, bottom, front, rear, left side and right side surfaces, the cushion body also including at least one heat generator pocket especially designed, shaped and configured as a recessed area running from an opening formed at the top surface of the cushion towards the bottom surface of the cushion, said recess having a shape and dimensions especially configured to enable the heat generator pocket to receive and contain the at least one heat generator carrier, the cushion body also including at least one ventilation conduit aperture formed within the cushion body, the conduit aperture having a length and a diameter and running from an opening formed within the a side wall of the heat generator pocket and running thence to an opening located on one of the side surfaces of the cushion body, the diameter and length of the at least one ventilation conduit aperture enabling retentive placement therein of the at least one ventilation conduit;

the at least one heat generator carrier having a bottom section, rear side wall, front side wall, right side wall, left side wall and a top cover, the top cover being configured and adapted to open so as to expose an interior of the caddy for placement and removal therein of a heat generator and to close down into a locking position so as to firmly hold the heat generator within the interior of the caddy, each of the side walls of the caddy, as well as the top cover including therein ventilation apertures enabling gaseous exchange of air, combustion gases and heat generated by such combustion to flow in and out of the carrier during use, the at least one ventilation apertures formed within the walls of the carrier being advantageously formed so as to allow receipt and securing therein of the at least one ventilation conduits, each of said ventilation conduits including a ventilation conduit therein;

the at least one ventilation conduit being shaped as hollow tube having a central bore, an open proximal and distal end, said openings being continuous with the central bore of the ventilation conduit, the ventilation conduit demonstrating a diameter and length enabling secured placement within and engagement by the at least one ventilation aperture formed within the cushion body wherein, upon placement of the at least one ventilation conduit within the at least one ventilation aperture, a pathway enabling flow of air into, and combustion air from a heat generator contained within a heat generator carrier within the heat generator pocket is provided; and the seat cushion cover including an opening for each of the at least one ventilation conduits as well as an opening enabling access to each of the at least one heat generator pockets and heat generator carriers placed therewithin.

2. The portable seat cushion of claim 1 wherein the at least one heat generator pocket is located in a forward ⅓ portion of the cushion.

3. The portable seat cushion of claim 2 wherein the cushion includes two heat generator pockets, one of said pockets being located midway between the right surface and a midline of the cushion body and the second of said pockets being located midway between the left surface and the midline of the cushion body.

4. The portable seat cushion of claim 3 wherein the cushion further comprises two foam inserts especially shaped and configured to completely fill the heat generator pockets when they are not utilized for placement of a heat generator carrier.

5. The portable seat cushion of claim 4 wherein three ventilation apertures are formed within the cushion body, two of said apertures running from the right and left side surfaces of the cushion body to a side surface of each heat generator pocket and one of the ventilation apertures running from the front surface of the cushion to a front surface of each of the heat generator pockets.

6. The portable seat cushion of claim 1 wherein the back surface of the cushion, at the midpoint thereof, includes a tail bone cutaway indentation especially formed to relieve pressure against a user's coccyx.

7. The portable seat cushion of claim 1 wherein the ventilation conduits include an anchor ring portion located at the medial and distal ends thereof and wherein apertures formed within the front and side walls of the heat generator carrier are especially shaped and configured to enable insertion of the anchor ring portion therein for secure retention therein.

8. The portable seat cushion of claim 7 further comprising two heater overlay foam inserts especially shaped, configured and demonstrating a thickness so that, when placed on top of the heat generator carrier, the inserts provide attenuation of the amount of heat passing from the heat generator caddy to a user when a heat generator is in use.

9. The portable seat cushion of claim 1 wherein the cushion body is formed from a foam material.

10. The portable seat cushion of claim 9 wherein the foam material is selected from the group consisting of a polyethylene, polyurethane foam and latex foam.

11. The portable seat cushion of claim 1 wherein the heat generator carrier is formed from a metal material.

12. The portable seat cushion of claim 11 wherein the metal material is selected from the group consisting of aluminum, steel and steel alloys.

13. The portable seat cushion of claim 1 wherein the heat generator carrier is formed from a plastic material.

14. The portable seat cushion of claim 13 wherein the plastic material is selected from polycarbonate, polyamideimides (PAIs), high-performance polyamides (HPPAs), polyimides (Pis), polyketones, polysulfone derivatives-a, polycyclohexane dimethyl-terephthalates (PCTs), fluoropolymers, polyetherimides (PEIs), polybenzimidazoles (PBIs), polybutylene terephthalates (PBTs), polyphenylene sulfides and syndiotactic polystyrene.

15. The portable seat cushion of claim 1 wherein the heat generator incorporated is a naphtha fueled hand warmer.

16. The portable seat cushion of claim 1 wherein the heat generator is an electric hand warmer.

* * * * *